US009461413B2

(12) United States Patent
Duan et al.

(10) Patent No.: US 9,461,413 B2
(45) Date of Patent: Oct. 4, 2016

(54) INTERFERENCE PROOF ELECTRICAL RECEPTACLE CONNECTOR

(71) Applicant: Advanced-Connectek Inc., New Taipei (TW)

(72) Inventors: Shu-Lin Duan, New Taipei (TW); Fu-Yi Xu, New Taipei (TW); Ching-Tien Chen, New Taipei (TW); Wei Wan, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/972,684

(22) Filed: Dec. 17, 2015

(65) Prior Publication Data

US 2016/0181733 A1 Jun. 23, 2016

(30) Foreign Application Priority Data

Dec. 23, 2014 (CN) ..... 2014 1 0805008

(51) Int. Cl.
*H01R 13/648* (2006.01)
*H01R 13/6585* (2011.01)

(52) U.S. Cl.
CPC ..... *H01R 13/6585* (2013.01)

(58) Field of Classification Search
CPC ..... H01R 13/6581; H01R 13/6585; H01R 13/6587
USPC ..... 439/79, 607.05, 607.07
See application file for complete search history.

(56) References Cited

U.S. PATENT DOCUMENTS 8,734,187 B2 * 5/2014 De Geest ..... H01R 13/6587 439/607.05
8,784,134 B2 * 7/2014 Wu ..... H01R 13/6598 439/607.05
8,858,243 B2 * 10/2014 Luo ..... H01R 13/652 439/108
8,899,996 B2 * 12/2014 Lim ..... H01R 12/724 439/607.05
9,022,800 B2 * 5/2015 Yang ..... H01R 13/6581 439/487

* cited by examiner

*Primary Examiner* — Khiem Nguyen
(74) *Attorney, Agent, or Firm* — Lynette Wylie; Apex Juris, pllc.

(57) ABSTRACT

An interference proof electrical receptacle connector has an insulative housing, a mounting bracket, a first terminal set, a second terminal set, a shell and a metal cover. The mounting bracket is mounted on the insulative housing. The first terminal set is mounted on the mounting bracket. The second terminal set is mounted on the insulative housing. The shell is mounted on the insulative housing and the mounting bracket and has a cavity. The metal cover is mounted securely on the shell and has a cover body and multiple soldering feet. The cover body is mounted securely on a top surface of the shell. The soldering feet are formed on and protrude downward from the cover body. The metal cover enhances the structural strength of the shell to improve the durability of repeated engagement and disengagement of the interference proof electrical receptacle connector.

9 Claims, 10 Drawing Sheets

INTERFERENCE PROOF ELECTRICAL RECEPTACLE CONNECTOR

BACKGROUND OF THE INVENTION

1. Field of the Invention

The present invention relates to a connector, and more particularly to an interference proof electrical receptacle connector that has a shell mounted on a circuit board by a fastening element to improve the structural strength of the shell. Furthermore, the shell is manufactured without any through hole to prevent electromagnetic interference (EMI) and radio frequency interference (RFI).

2. Description of Related Art

Universal Serial Bus (USB) 3.1 protocol is further developed to include USB Type C connector that is able to provide ultrahigh data transmission speed of 10 Gbps and has a light and compact structure especially suitable for portable devices. The USB Type C connector is also featured with a reversible socket for reversible connection for extensive applications on different electronic devices.

Because super speed signal terminals of the USB type C connector, when operating, radiate electromagnetic waves within a certain frequency extent that interfere with other wired or wireless devices or are interfered by the electromagnetic waves emitted from other operating wired or wireless devices, a requirement of EMI and RFI proof functions for the USB type C connector is more important than other conventional connectors. Generally, a shell of the USB type C connector provides EMI and RFI proof functions.

Furthermore, a conventional USB type C receptacle connector is equipped with a shell including soldering legs that are manufactured by a stamp process. The soldering legs are soldered on a circuit board such that the USB Type C receptacle connector is mounted securely on the circuit board. However, the aforementioned stamping process produces through holes on the shell such that the EMI and RFI proof functions of the shell are decreased.

To overcome the shortcomings, the present invention provides an interference proof electrical receptacle connector to mitigate or obviate the aforementioned problems.

SUMMARY OF THE INVENTION

The main objective of the invention is to provide an interference proof electrical receptacle connector that has a shell mounted on a circuit board by a fastening element to improve the structural strength of the shell. Furthermore, the shell is manufactured without any through hole to prevent EMI and RFI.

An interference proof electrical receptacle connector in accordance with the present invention comprises an insulative housing, a mounting bracket, a first terminal set, a second terminal set, a shell and a metal cover. The mounting bracket is mounted on the insulative housing. The first terminal set is mounted on the mounting bracket. The second terminal set is mounted on the insulative housing. The shell is mounted on the insulative housing and the mounting bracket and has a cavity. The metal cover is mounted securely on the shell and has a cover body and multiple soldering feet. The cover body is mounted securely on a top surface of the shell. The soldering feet are formed on and protrude downward from the cover body. The metal cover enhances the structural strength of the shell to improve the durability of repeated engagement and disengagement of the interference proof electrical receptacle connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
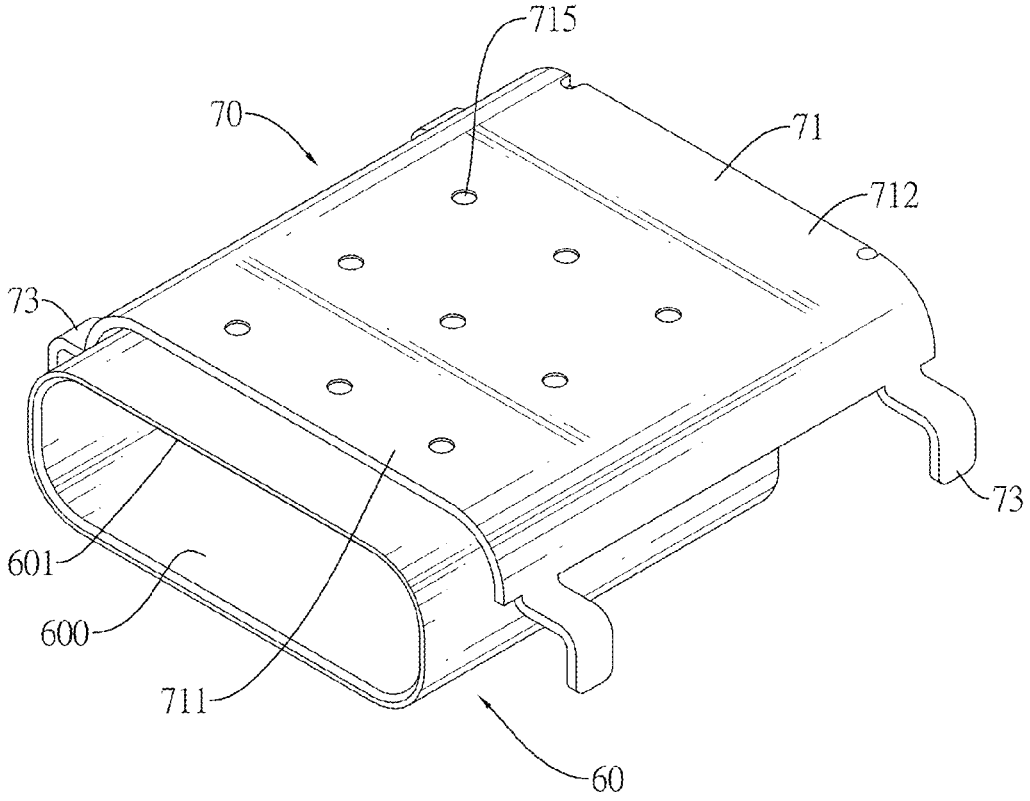
FIG. 1 is a perspective view of a first embodiment of an interference proof electrical receptacle connector in accordance with the present invention.
Figure 2:
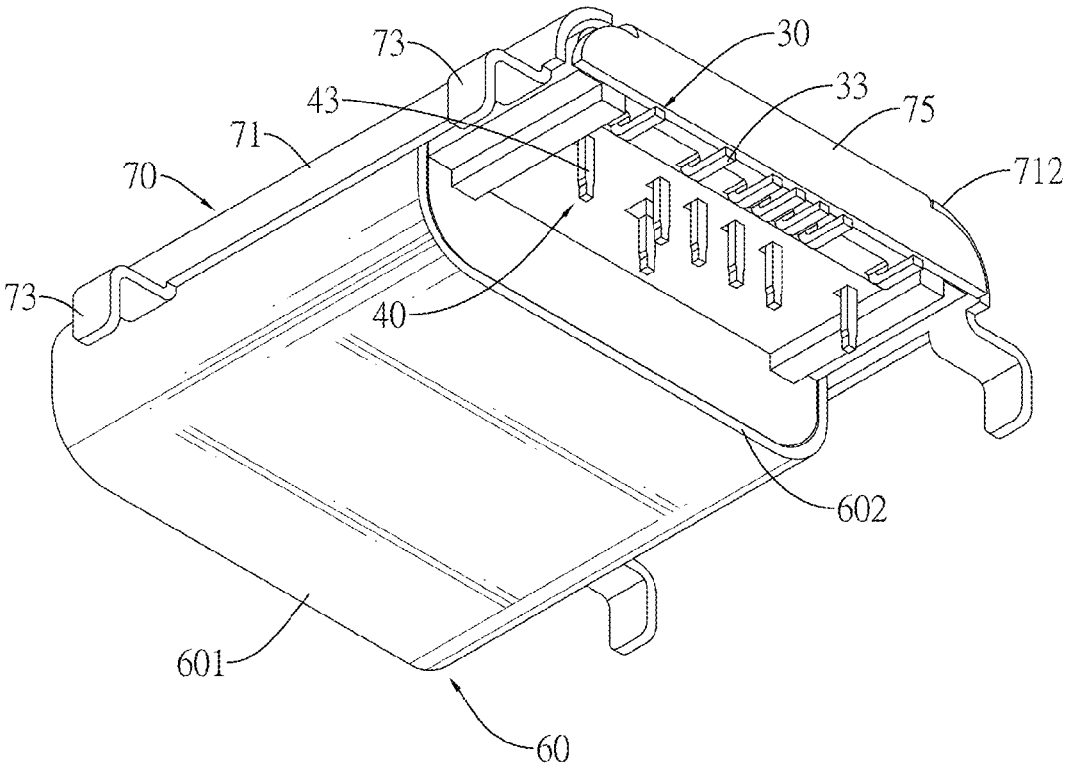
FIG. 2 is another perspective view of the interference proof electrical receptacle connector in FIG. 1.

With reference to FIGS. 1 and 2, a first embodiment of an interference proof electrical receptacle connector comprises an insulative housing 10, a mounting bracket 20, a first terminal set, a second terminal set, a grounding and shielding plate 50, a shell 60 and a metal cover 70.

The mounting bracket 20 is mounted on a top of the insulative housing 10 adjacent a rear end of the insulative housing 10.

Figure 3:
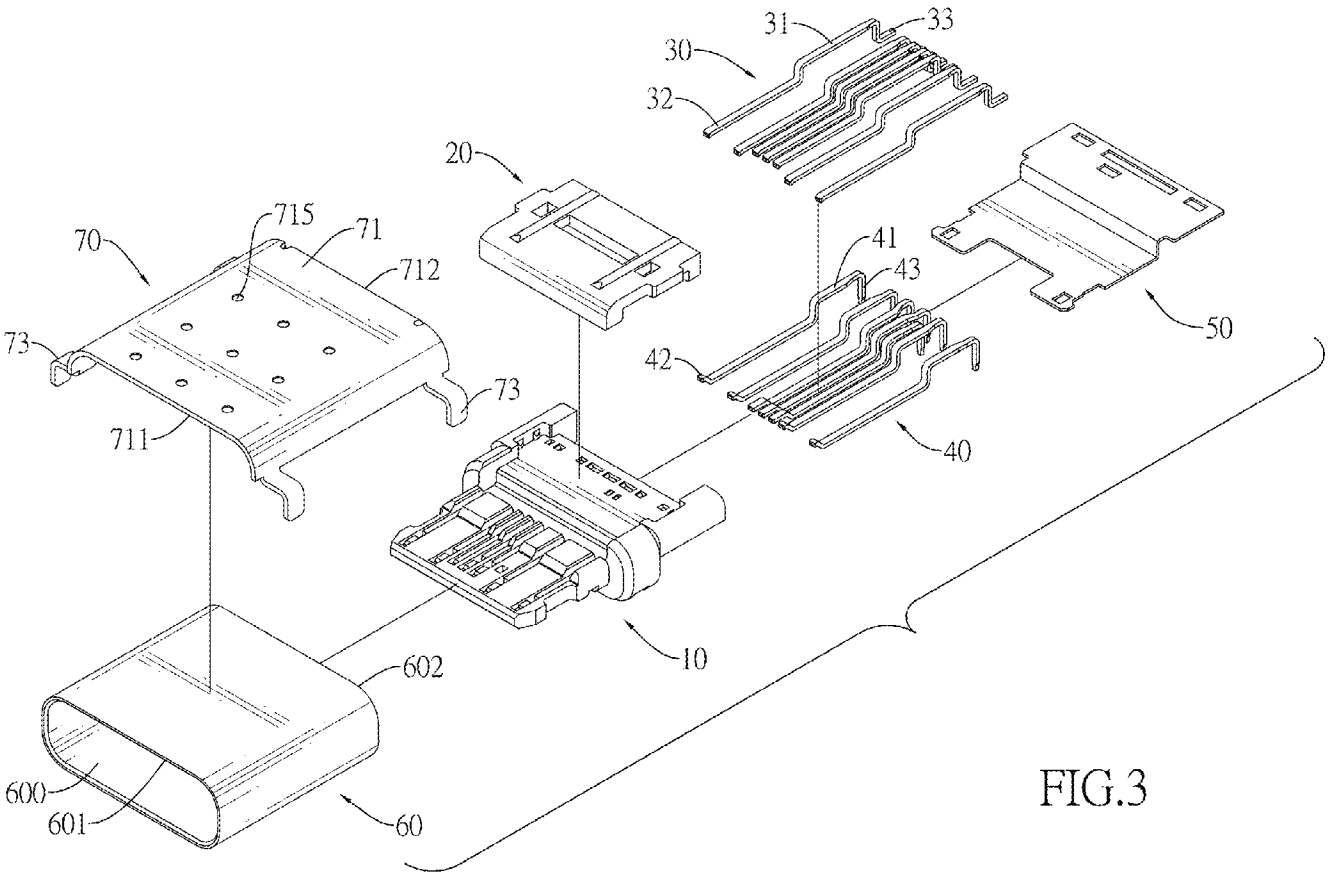
FIG. 3 is an exploded perspective view of the interference proof electrical receptacle connector in FIG. 1.
Figure 4:
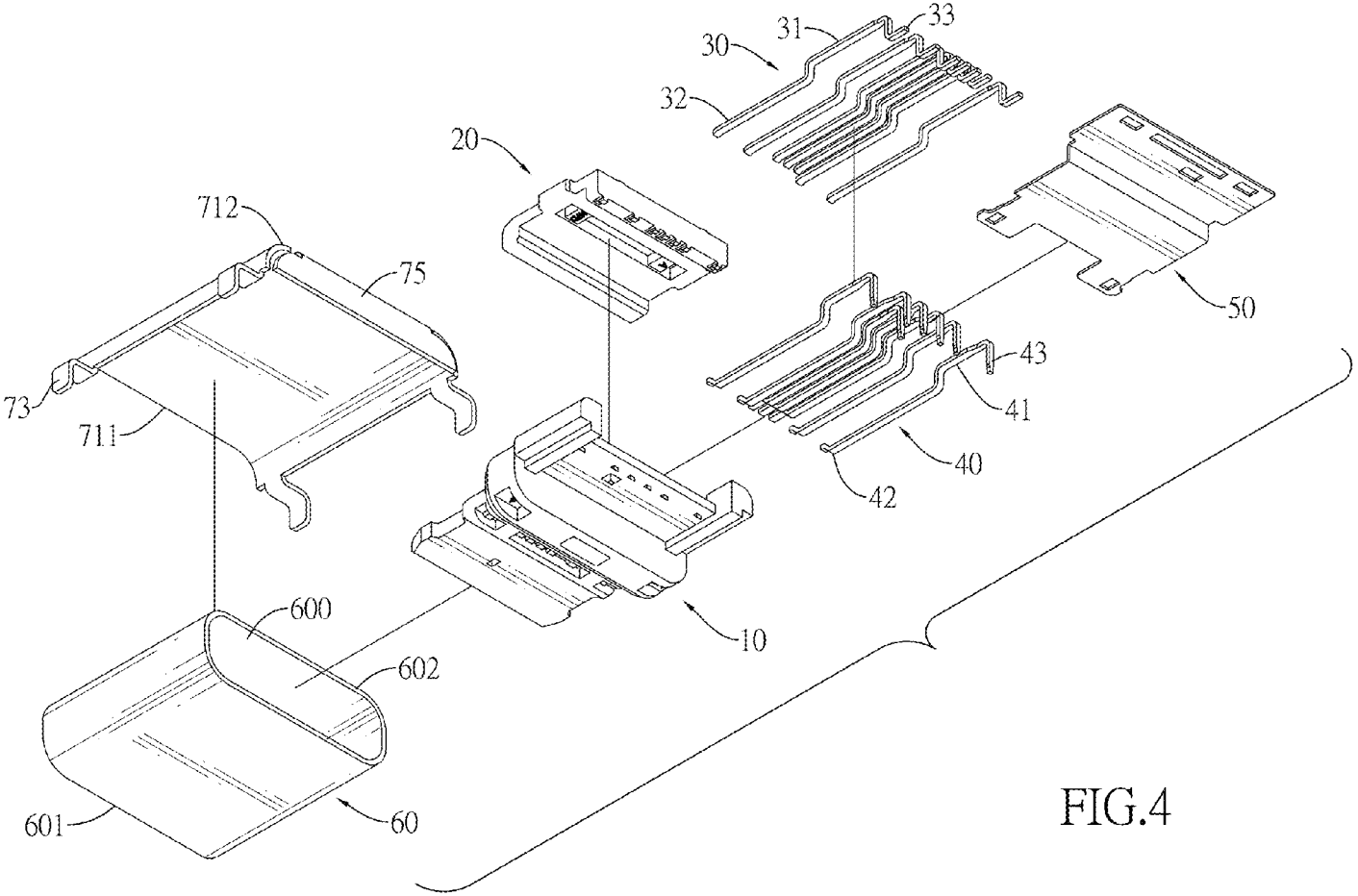
FIG. 4 is another exploded perspective view of the interference proof electrical receptacle connector in FIG. 1.

With further reference to FIGS. 3 and 4, the first terminal set is mounted on the mounting bracket 20 and has multiple first terminals 30. The first terminals 30 are mounted on the mounting bracket 20 above the top of the insulative housing 10 and each first terminal 30 has a first mounting section 31, a first electrical contacting section 32 and a first soldering section 33. The first mounting section 31 is mounted in the mounting bracket 20. The first electrical contacting section 32 is formed on and protrudes forward from the first mounting section 31 and is mounted on the top of the insulative housing 10. The first soldering section 33 is formed on and protrudes backward from the first mounting section 31.

The second terminal set is mounted on the insulative housing 10 and has multiple second terminals 40. The second terminals are mounted on the insulative housing 10 and each second terminal 40 has a second mounting section 41, a second electrical contacting section 42 and a second soldering section 43. The second mounting section 41 is mounted in the insulative housing 10. The second electrical contacting section 42 is formed on and protrudes forward from the second mounting section 41 and is mounted on the top of the insulative housing 10. The second soldering section 43 is formed on and protrudes backward from the second mounting section 41. The first terminal set and the second terminal set are point symmetrical relative to a central point defined between the first terminal set and the second terminal set.

Figure 5:
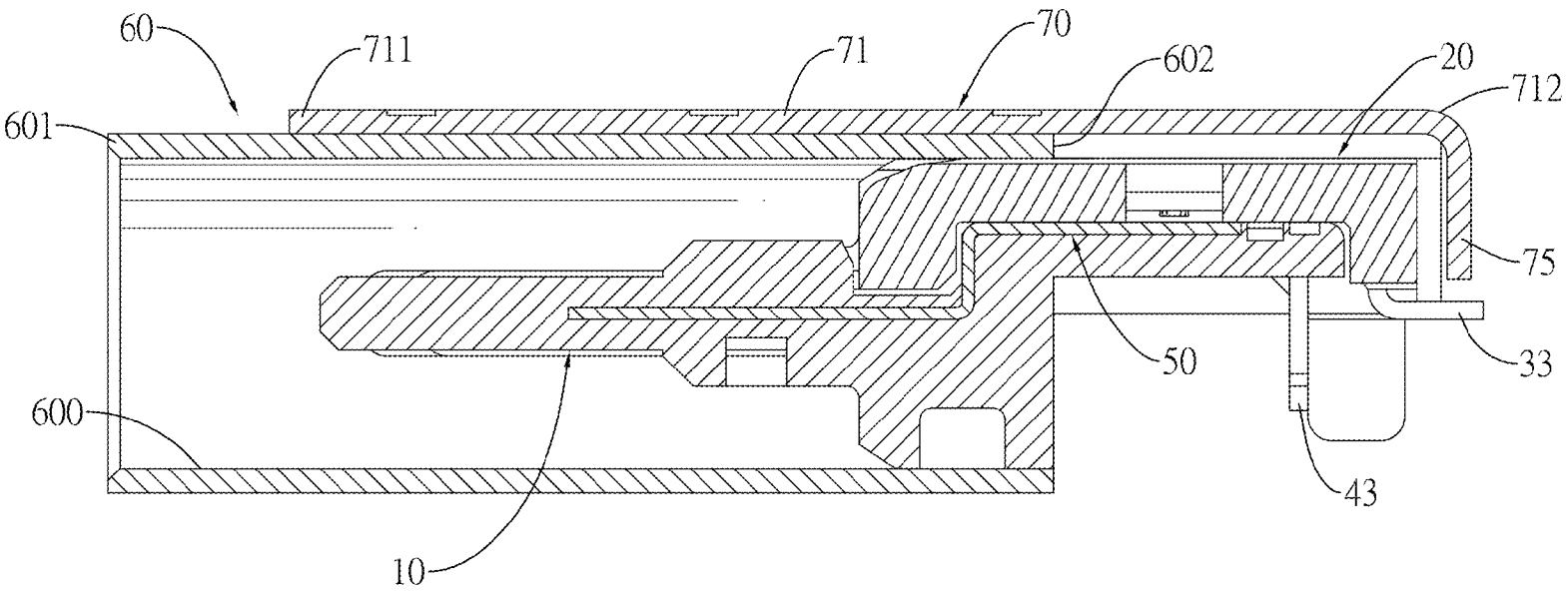
FIG. 5 is a cross sectional side view of the interference proof electrical receptacle connector in FIG. 1.
Figure 6:
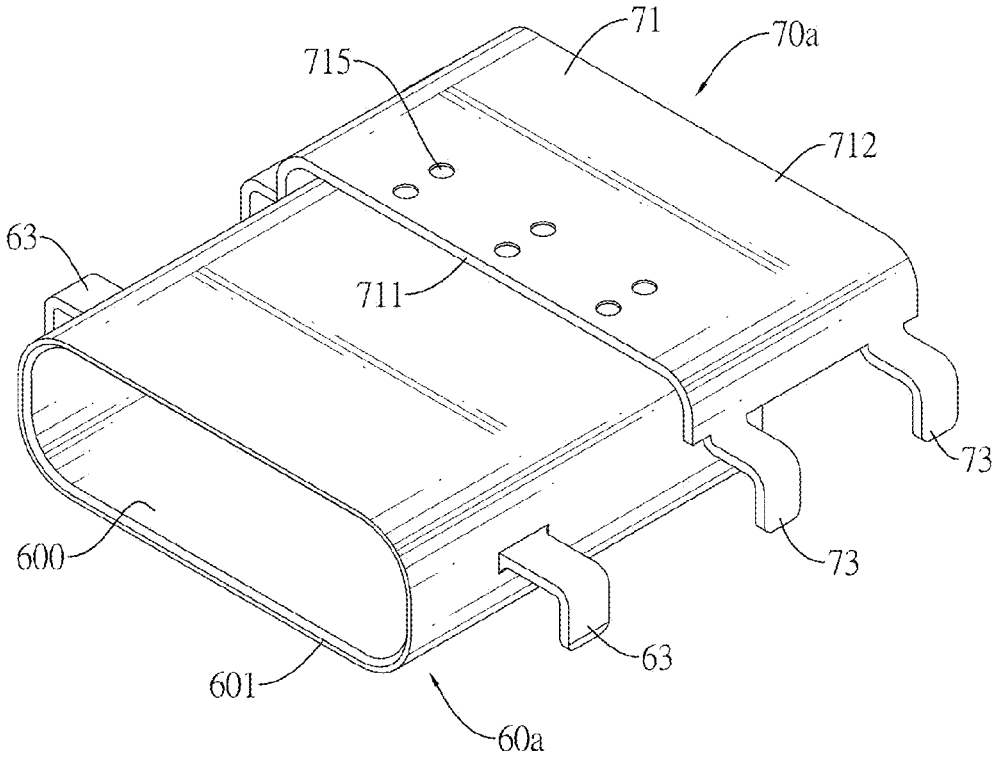
FIG. 6 is a perspective view of a second embodiment of an interference proof electrical receptacle connector in accordance with the present invention.
Figure 7:
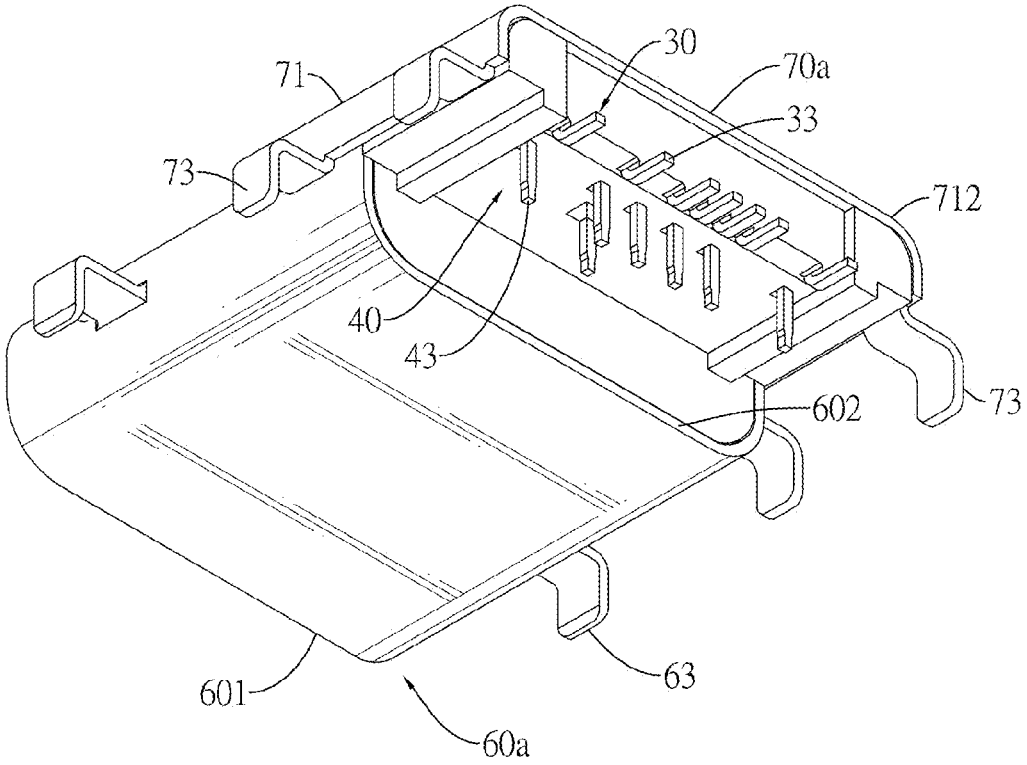
FIG. 7 is another perspective view of the interference proof electrical receptacle connector in FIG. 6.
Figure 8:
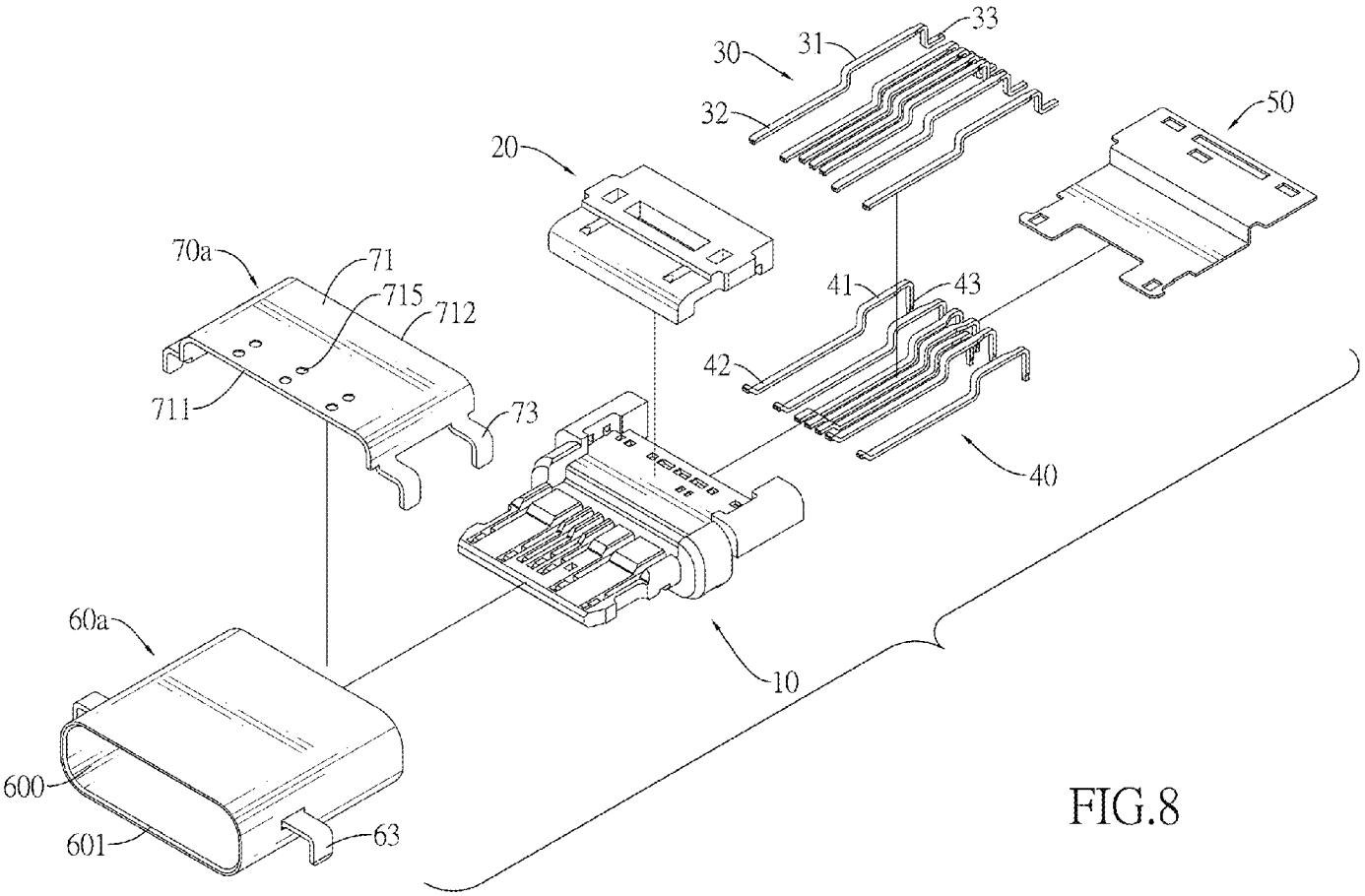
FIG. 8 is an exploded perspective view of the interference proof electrical receptacle connector in FIG. 6.
Figure 9:
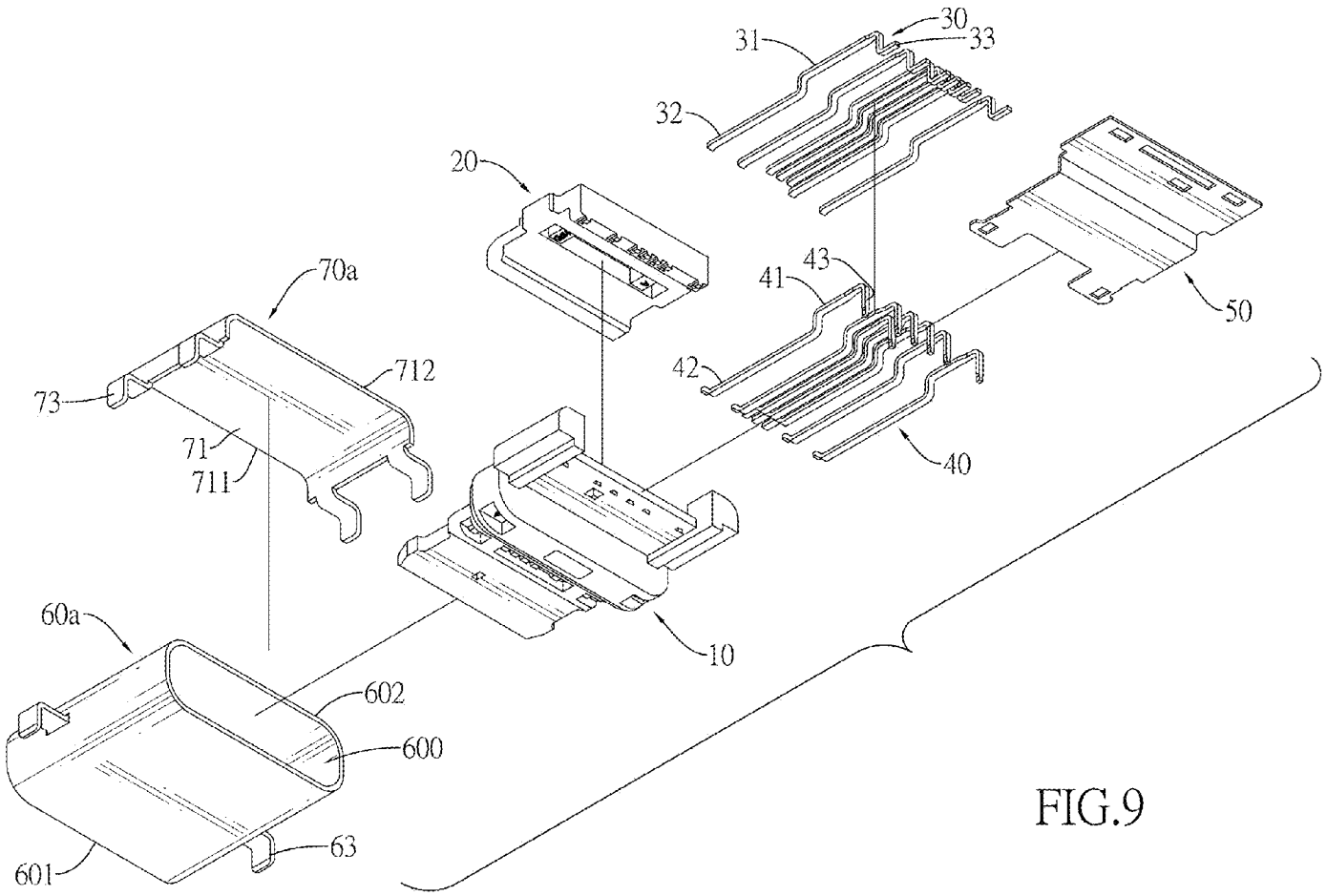
FIG. 9 is another exploded perspective view of the interference proof electrical receptacle connector in FIG. 6.
Figure 10:
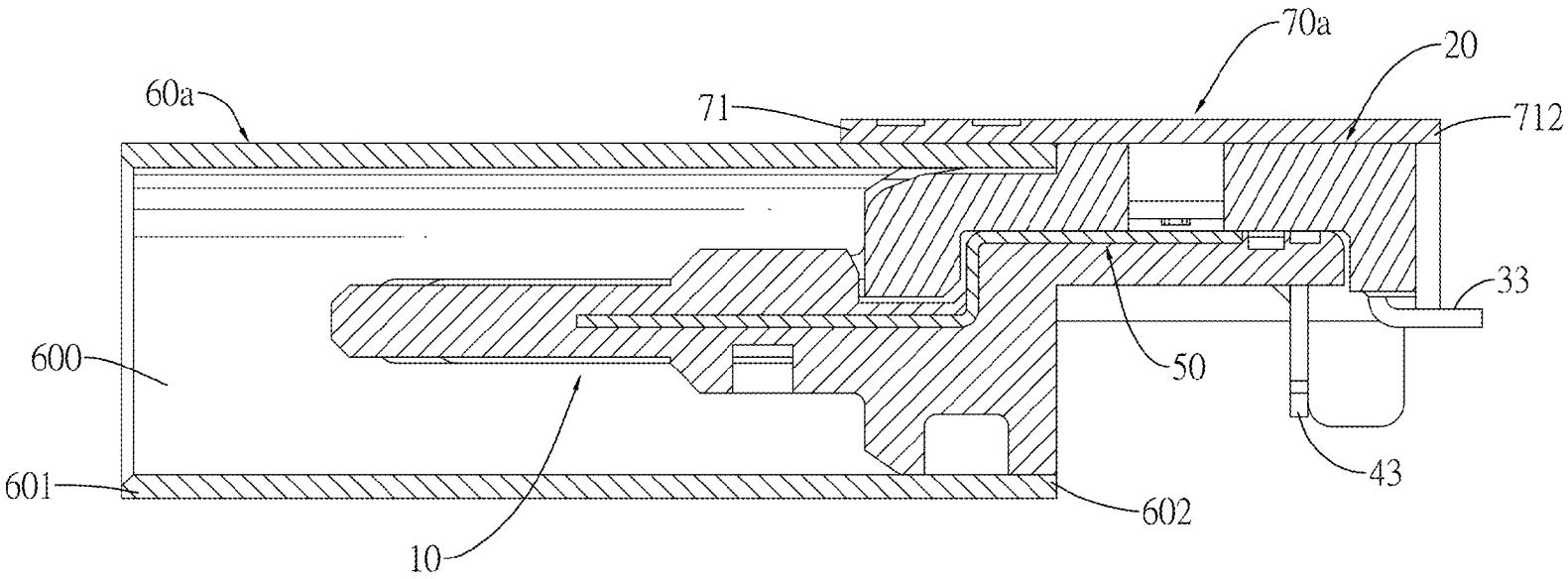
FIG. 10 is a cross sectional side view of the interference proof electrical receptacle connector in FIG. 6.

With further reference to FIG. 5, the grounding and shielding plate 50 is mounted in the insulative housing 10 by an insert-molding process and is located between the first terminals 30 and the second terminals 40.

The shell 60 is mounted on the insulative housing 10 and the mounting bracket 20 and has a cavity 600 without any other through holes. The cavity 60 is defined through the shell 60 from a front end to a rear end of the shell 60 and accommodates the insulative housing 10 and the mounting bracket 20.

The metal cover 70 is mounted securely on the shell 60 and has a cover body 71, multiple soldering feet 73 and a rear shield plate 75. The cover body 71 is mounted securely on a top surface of the shell 60. A front end 711 of the cover body 71 is located on the top surface of the shell 60 and near a front edge 601 of the shell 60. A rear end 712 of the cover body 71 extends backward over the rear end of the shell 60 for a distance. Furthermore, the cover body 71 has multiple laser welding notches 715 defined in the top surface of the cover body 71. The laser welding notches 715 allow the metal cover 70 to be laser welded on the shell 60. The soldering feet 73 are formed on and protrude downward from the cover body 71 for being soldered on a circuit board. The rear shield plate 75 is formed on and protrudes downward from the rear end 712 of the cover body 71.

With reference to FIGS. 6 to 10, a second embodiment of the interference proof electrical receptacle connector comprises an insulative housing 10, a mounting bracket 20, a first terminal set, a second terminal set, a grounding and shielding plate 50, a shell 60*a* and a metal cover 70*a*.

The front end 711 of the cover body 71 of the metal cover 70*a* is located on the top surface of the shell 60*a* and near the rear end 602 of the shell 60*a*. The rear end 712 of the cover body 71 extends backward over the shell 60*a* for a distance. The shell 60*a* has multiple soldering feet 63 formed on and protruding from the shell 60*a* by a metal injection molding process such that the soldering feet 63 are soldered on the circuit board.

The interference proof electrical receptacle connector has the following advantages.

1. The shell 60 is not made by a stamping process and has no through hole defined therethrough. The structural strength and entirety of the shell 60 are enhanced. Therefore, EMI and RFI proof functions and durability of repeated engagement and disengagement of the interference proof electrical receptacle connector are improved.

2. The metal cover 70 mounted securely on the shell 60 by the laser welding process or fastening process has the soldering feet 73 such that the shell 60 may be manufactured without any soldering feet. Therefore, the shell 60 can be manufactured as a standard part suitable for different electric connectors. Thus, manufacturing cost of molds is lowered. The metal cover 70 also enhances the structural strength of the shell 60 to improve the durability of repeated engagement and disengagement of the interference proof electrical receptacle connector.

3. The rear shield plate 75 of the metal cover 70 provides EMI and RFI shielding functions to the first terminal set and the second terminal set.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An interference proof electrical receptacle connector comprising:

an insulative housing;

a mounting bracket mounted on a top of the insulative housing adjacent a rear end of the insulative housing;

a first terminal set mounted on the mounting bracket and having multiple first terminals mounted on the mounting bracket above the top of the insulative housing and each first terminal having a first mounting section mounted in the mounting bracket;

a first electrical contacting section formed on and protruding forward from the first mounting section and mounted on the top of the insulative housing; and a first soldering section formed on and protruding backward from the first mounting section;

a second terminal set mounted on the insulative housing and having multiple second terminals mounted on the insulative housing and each second terminal having a second mounting section mounted in the insulative housing;

a second electrical contacting section formed on and protruding forward from the second mounting section and mounted on the top of the insulative housing;

a second soldering section formed on and protruding backward from the second mounting section; wherein the first terminal set and the second terminal set are point symmetrical relative to a central point defined between the first terminal set and the second terminal set;

a shell mounted on the insulative housing and the mounting bracket and having a cavity defined through the shell from a front end to a rear end of the shell and accommodating the insulative housing and the mounting bracket; and a metal cover mounted securely on the shell and having a cover body mounted securely on a top surface of the shell; and multiple soldering feet formed on and protruding downward from the cover body.

2. The interference proof electrical receptacle connector as claimed in claim 1, wherein a front end of the cover body is located on the top surface of the shell and near a front edge of the shell; a rear end of the cover body extends backward over the rear end of the shell for a distance.

3. The interference proof electrical receptacle connector as claimed in claim 1, wherein a front end the cover body of the metal cover is located on the top surface of the shell and near the rear end of the shell; a rear end of the cover body extends backward over the shell for a distance.

4. The interference proof electrical receptacle connector as claimed in claim 2, wherein the metal cover further has a rear shield plate formed on and protruding downward from the rear end of the cover body.

5. The interference proof electrical receptacle connector as claimed in claim 3, wherein the metal cover further has a rear shield plate formed on and protruding downward from the rear end of the cover body.

6. The interference proof electrical receptacle connector as claimed in claim 4 further comprising a grounding and shielding plate mounted in the insulative housing and located between the first terminals and the second terminals.

7. The interference proof electrical receptacle connector as claimed in claim 5 further comprising a grounding and shielding plate mounted in the insulative housing and located between the first terminals and the second terminals.

8. The interference proof electrical receptacle connector as claimed in claim 6, wherein the cover body has multiple laser welding notches defined in a top surface of the cover body.

9. The interference proof electrical receptacle connector as claimed in claim 7, wherein the cover body has multiple laser welding notches defined in a top surface of the cover body.

* * * * *